US006440628B1

(12) United States Patent
Watanabe et al.

(10) Patent No.: US 6,440,628 B1
(45) Date of Patent: Aug. 27, 2002

(54) TONES FOR DEVELOPMENT OF ELECTROSTATIC IMAGE AND PRODUCTION PROCESS THEREOF

(75) Inventors: Makoto Watanabe; Katsuhiro Imai, both of Kanagawa (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 09/486,534

(22) PCT Filed: Aug. 28, 1998

(86) PCT No.: PCT/JP98/03843

§ 371 (c)(1),
(2), (4) Date: Feb. 28, 2000

(87) PCT Pub. No.: WO99/12078

PCT Pub. Date: Mar. 11, 1999

(30) Foreign Application Priority Data

Aug. 29, 1997 (JP) ..... 9-249601

(51) Int. Cl.[7] ..... G03G 9/09
(52) U.S. Cl. ..... 430/108.9; 430/137.17
(58) Field of Search ..... 430/106, 137, 430/108.9, 137.17

(56) References Cited

U.S. PATENT DOCUMENTS

| | | | | |
|---|---|---|---|---|
| 4,138,471 A | * | 2/1979 | Lamond et al. | 423/460 |
| 5,306,589 A | * | 4/1994 | Yamamoto et al. | 430/106 |
| 5,759,728 A | | 6/1998 | Hagi et al. | 430/106 |
| 5,973,054 A | * | 10/1999 | Kushino | 430/137 |

FOREIGN PATENT DOCUMENTS

| | | |
|---|---|---|
| EP | 0845712 | 6/1998 |
| JP | 56-106250 | 8/1981 |
| JP | 57-181553 | 11/1982 |
| JP | 60-138563 | 7/1985 |
| JP | 61-22353 | 1/1986 |
| JP | 63-011957 | 1/1988 |
| JP | 63-113560 | 5/1988 |
| JP | 1-306864 | 12/1989 |
| JP | 2-296255 | 12/1990 |
| JP | 3-005765 | 1/1991 |
| JP | 3-175456 | 7/1991 |
| JP | 3-177848 | 8/1991 |
| JP | 3-2103746 | 9/1991 |
| JP | 4-070761 | 3/1992 |
| JP | 4-139460 | 5/1992 |
| JP | 4-142561 | 5/1992 |
| JP | 5-289405 | 11/1993 |
| JP | 10-097103 | 4/1998 |

* cited by examiner

*Primary Examiner*—Christoper Rodee
(74) *Attorney, Agent, or Firm*—Dinsmore & Shohl LLP

(57) ABSTRACT

A toner for development of electrostatic images comprising carbon black as a colorant, wherein the carbon black has the following features:

(1) the primary particle diameter being within a range of 28 to 60 nm;

(2) the DBP oil absorption being within a range of 40 to 75 ml/100 g; and (3) the pH being within a range of 6.0 to 10.0, and a production process of the toner by a suspension polymerization process.

19 Claims, No Drawings

TONES FOR DEVELOPMENT OF ELECTROSTATIC IMAGE AND PRODUCTION PROCESS THEREOF

TECHNICAL FIELD

The present invention relates to a toner for development of electrostatic images, comprising carbon black as a colorant, and more particularly to a toner for development of electrostatic images, which is excellent in various properties such as flowability, shelf stability, charging properties, environmental stability of image quality and durability of image quality, and is markedly improved in safety so as to inhibit an adverse influence on the human body and environment, and a production process thereof.

BACKGROUND ART

In an image forming apparatus such as an electrophotographic apparatus or electrostatic recording apparatus, a photosensitive member evenly and uniformly charged has heretofore been exposed to a light pattern to form an electrostatic latent image (electrostatic image), and the electrostatic latent image has been developed with a developer. More specifically, the developer is applied to the electrostatic latent image to form a developer image (visible image). As needed, the developer image is then transferred to a transfer medium such as paper, and fixed to the transfer medium by a method such as heating, pressing or use of solvent vapor.

A main component of developers is a toner for development of electrostatic images composed of colored fine particles comprising a binder resin and a colorant. The developers include two-component developers composed of a toner and carrier particles, and one-component developers composed substantially of a toner alone and making no use of any carrier particles. The one-component developers include magnetic one-component developers containing magnetic powder, and non-magnetic one-component developers containing no magnetic powder. In general developers, a flowability-imparting agent such as colloidal silica is often added independently in order to enhance the flowability of the toner.

Processes for producing a toner are roughly divided into a grinding process and a polymerization process. In the grinding process, a synthetic resin, a colorant and optional other additives are melted and mixed, the mixture is ground, and the ground product is then classified so as to obtain particles having a desired particle diameter, thereby obtaining colored particles (ground toner). In the polymerization process, a polymerizable monomer composition containing a colorant and a polymerizable monomer, in which various additives such as a charge control agent are uniformly dissolved or dispersed as needed, is prepared, the polymerizable monomer composition is dispersed in an aqueous dispersion medium containing a dispersion stabilizer by means of a mixing device to form fine droplets (oil droplets) of the polymerizable monomer composition, and the dispersion containing the fine droplets is then heated to subject the droplets to suspension polymerization, thereby obtaining colored polymer particles (polymerized toner) having a desired particle diameter. Polymerized toners include those produced by, for example, an emulsion polymerization process, dispersion polymerization process and the like in addition to that by the suspension polymerization process.

Images formed by an image forming apparatus such as an electrophotographic copying machine are required to improve their definition year by year. As a toner used in the image forming apparatus, a toner obtained by the grinding process has heretofore been mainly used. The grinding process tends to form colored particles having a wide particle diameter distribution. In order for the toner to exhibit satisfactory developing characteristics, therefore, the ground product must be classified to adjust the particles so as to have a particle diameter distribution limited to a certain extent. According to the polymerized toner on the other hand, a toner having even particle diameter can be provided without need of grinding and classification by controlling the droplet diameter and droplet diameter distribution of droplets of the polymerizable monomer composition in a polymerization step.

According to the suspension polymerization process among the polymerization processes, a toner scarcely containing residual ions caused by an emulsifying agent and the like can be provided in a spherical form near to a sphere. The spherical toner has excellent developing characteristics and permits the formation of high-quality images. The toner scarcely containing residual ions has good environmental stability and permits the provision of stable image quality even when environmental temperature and humidity vary. As a matter of fact, however, it is difficult to conduct the polymerization while uniformly dispersing the colorant in the polymerizable monomer composition and retaining the uniformly dispersed state. It is also difficult to conduct the polymerization while evenly controlling the droplet diameter of the droplets of the polymerizable monomer composition in the aqueous dispersion medium and stably dispersing the droplets in the dispersion medium.

For example, carbon black typical of the colorants is easy to aggregate, and so it is difficult to uniformly disperse the carbon black in a polymerizable monomer composition and retain the uniformly dispersed state. The carbon black tends to exert an adverse influence on the dispersion stability of droplets of the polymerizable monomer composition in the aqueous dispersion medium. As a result, it is difficult to provide a toner having a narrow particle diameter distribution.

On the other hand, there is also an increasing demand for prevention of environmental pollution by gasses and volatile components discharged from electrophotographic copying machines and printers with the enhancement of the demand for high image quality. For example, these image forming apparatus tend to generate ozone. Therefore, measures to change charging means and transferring means from corona discharge devices to charging rollers or belts and the like are taken to prevent the generation of ozone. In the polymerized toners, odor attributed to residual monomers, catalyst residue, solvents, etc. becomes a problem. Accordingly, measures to prevent the generation of odor and volatile components are taken by, for example, selecting the kind of a polymerization initiator.

However, sufficient measures have not been taken against a problem of environmental pollution caused by colorants. More specifically, carbon black generally used as a colorant contains a trace amount of polycyclic aromatic hydrocarbons such as benzo(a)pyrene which is known to be a carcinogen. Fears are entertained that these trace components contained in a toner will adversely affect the human body and environment by scattering of a developer from an image forming apparatus. Therefore, improvement in the safety of a toner containing carbon black becomes an important problem. In order to enhance the safety of the toner containing carbon black, it is considered that to reduce the content of polycyclic aromatic hydrocarbons in the toner as much as possible is effective.

Nevertheless, as a result of an investigation by the present inventors, it has been found that when carbon black containing a smaller amount of polycyclic aromatic hydrocarbons is used, it is difficult to obtain a toner capable of providing images excellent in image quality. In particular, when a toner is produced by the suspension polymerization process, the mere use of the carbon black containing a smaller amount of polycyclic aromatic hydrocarbons lower the dispersibility of the carbon black in a polymerizable monomer composition and the dispersion stability of droplets of the polymerizable monomer composition in an aqueous dispersion medium, resulting in difficulty to obtain a toner capable of providing high-definition images.

There have heretofore been made various proposals on improvement in the dispersibility of carbon black and reduction in volatile components in polymerized toners.

For example, (1) Japanese Patent Application Laid-Open No. 106250/1981 has proposed a process for producing a toner for development of electrostatic images, in which a polymerizable monomer is polymerized in the presence of carbon black having a volatile content of 6 wt. % or lower. In this publication, groups bonded to carbon black, such as carboxyl, phenolic hydroxyl, sulfonic and carbonyl groups, deposits having such a group or an ionic active group, and active gasses adsorbed are mentioned as volatile components. The publication shows Examples making use of carbon black containing such volatile components in an amount of 1.0 to 5.0 wt. %.

(2) Japanese Patent Application Laid-Open No. 181553/1982 discloses a process for producing a toner for development of electrostatic images by polymerizing a polymerizable monomer containing carbon black whose DBP oil absorption is 70 to 280 ml/100 g, preferably 100 to 250 ml/100 g and whose pH is at least 6.0 for the purpose of improving the dispersibility of the carbon black in the polymerizable monomer.

(3) Japanese Patent Application Laid-Open No. 22353/1986 discloses a process for producing a toner for development of electrostatic images by the suspension polymerization process in the presence of carbon black whose volatile content is 1 to 2 wt. % under drying by heating at 950° C. for 7 minutes and whose pH is 3 to 4 for the purpose of uniformly dispersing the carbon black in the resulting toner.

(4) Japanese Patent Application Laid-Open No. 11957/1988 discloses a process for producing a toner for development of electrostatic images, in which a mixture containing carbon black having a number average particle diameter of 40 to 300 mμ(nm) for the purpose of uniformly dispersing the carbon black in a polymerizable monomer, and the polymerizable monomer is subjected to suspension polymerization.

(5) Japanese Patent Application Laid-Open No. 19662/1988 discloses spherical toner particles in which a number average particle diameter of carbon black dispersed in the toner particles is 20 to 500 mμnm), and a standard deviation value in the dispersion of carbon black particles is at least 70. In this publication, it is described to produce the spherical toner by the suspension polymerization process and thus obtain a toner free from any reaggregation of carbon black dispersed in a polymerizable monomer. Examples of this publication show spherical toners containing carbon black having a number average particle diameter of 88 to 144 mμ(nm).

As described above, various proposals have heretofore been made on carbon black used as a colorant. However, these proposals are not yet sufficient as to a point that image quality is reconciled with the prevention of environmental pollution. The carcinogenic polycyclic aromatic hydrocarbons contained in carbon black have not been sufficiently recognized by the prior art, and countermeasures against it have been naturally insufficient.

For example, when the pH of carbon black is low even when the volatile content in the carbon black is low, the dispersion of droplets of a polymerizable monomer in an aqueous dispersion medium is liable to become unstable. In particular, when a hardly water-soluble inorganic dispersing agent is used as a dispersion stabilizer, the dispersion stabilizer does not sufficiently function. When the DBP oil absorption of carbon black is high even when the content of volatile components in the carbon black is low, the aggregation of the carbon black in a polymerizable monomer composition is liable to occur. Accordingly, in these cases, it is difficult to obtain a toner capable of providing images excellent in image quality. Further, when the particle diameter of carbon black is great even when the content of volatile components in the carbon black is low, the content of the polycyclic aromatic hydrocarbons cannot be sufficiently reduced, and so apprehension is left about the safety of the resulting toner.

When the particle diameter of carbon black is small, the contents of the volatile components and polycyclic aromatic hydrocarbons in the carbon black tend to lower. When the pH of the carbon black is low, or the DBP oil absorption thereof is high, however, the same problems as described above tend to arise. Even when the particle diameter of carbon black is small, it is also desirable to reduce the content of the polycyclic aromatic hydrocarbons in the carbon black as much as possible in order to achieve higher safety.

When the DBP oil absorption of carbon black is too high even when the pH of the carbon black is high, the aggregation of the carbon black in a polymerizable monomer composition is liable to occur, and the resulting toner tends to produce fog. When the content of volatile components in the carbon black is high, or the particle diameter thereof is great even when the pH of the carbon black is high, apprehension is left about the safety of the resulting toner.

As described above, it has been an unsolved problem in the prior art to highly balance image quality and safety in a toner for development of electrostatic images making use of carbon black as a colorant with each other.

DISCLOSURE OF THE INVENTION

It is an object of the present invention to provide a toner for development of electrostatic images, which uses carbon black as a colorant, can provide images good in image quality and high in safety.

More specifically, an object of the present invention is to provide a toner for development of electrostatic images, which is excellent in various properties such as flowability, shelf stability, charging properties, environmental stability of image quality and durability of image quality, and is markedly improved in safety so as to inhibit an adverse influence on the human body and environment, and a production process thereof.

Another object of the present invention is to provide a toner, which can-provide images good in image quality and has high safety, by the suspension polymerization process.

The present inventors have carried out an extensive investigation with a view toward overcoming the above-described problems involved in the prior art. As a result, it has been found that when carbon black having a primary particle diameter of 28 to 60 nm, a DBP oil absorption of 40 to 75 ml/100 g and a pH of 6.0 to 10.0 is used, a toner highly balanced between image quality and safety can be provided.

When the carbon black having these property values is used, the dispersibility of the carbon black in a polymerizable monomer composition and the dispersion stability of droplets of the polymerizable monomer composition in an aqueous dispersion medium become good even when the suspension polymerization process is adopted, and so a polymerized toner which can provide images excellent in image quality and has excellent safety can be obtained. From the viewpoint of high safety, it is desired that the carbon black used be such that the total content of polycyclic aromatic hydrocarbons is 15 ppm or lower, particularly 10 ppm or lower. The present invention has been led to completion on the basis of these findings.

According to the present invention, there is thus provided a toner for development of electrostatic images comprising carbon black as a colorant, wherein the carbon black has the following features:

(1) the primary particle diameter being within a range of 28 to 60 nm;

(2) the DBP oil absorption being within a range of 40 to 75 ml/100 g; and (3) the pH being within a range of 6.0 to 10.0.

According to the present invention, there is also provided a process for producing a toner for development of electrostatic images by subjecting a polymerizable monomer composition containing at least a polymerizable monomer and carbon black to suspension polymerization, the process comprising using, as the carbon black, that having the following features:

(1) the primary particle diameter being within a range of 28 to 60 nm;

(2) the DBP oil absorption being within a range of 40 to 75 ml/100 g; and (3) the pH being within a range of 6.0 to 10.0.

BEST MODE FOR CARRYING OUT THE INVENTION

The present invention will hereinafter be described in detail.

1. Toner for Development of Electrostatic Images

The toner for development of electrostatic images according to the present invention is composed of colored particles comprising a binder resin and carbon black and is produced in accordance with the ordinary production process of a toner except that specific carbon black is used as the colorant.

Typical production processes of a toner include (1) a process (grinding process) in which a synthetic resin (binder resin) and a colorant are melted and mixed together with optionally used other additives (for example, a charge control agent), the mixture is ground, and the ground product is then classified to obtain colored particles, and (2) a process (polymerization process) in which a polymerizable monomer composition containing a colorant and a polymerizable monomer, in which various additives such as a charge control agent are uniformly dissolved or dispersed as needed, is prepared, the polymerizable monomer composition is dispersed in an aqueous dispersion medium containing a dispersion stabilizer by means of a mixing device to form fine droplets (oil droplets) of the polymerizable monomer composition, and the dispersion containing the fine droplets is then subjected to suspension polymerization, thereby obtaining colored polymer particles in which the colorant is dispersed in a polymer (binder resin) formed. The toner according to the present invention can be produced in accordance with any of these processes known per se in the art except that carbon black having the above-described property values is used.

(Carbon Black)

In the present invention, carbon black is used as a colorant. The carbon black useful in the practice of the present invention has the following property values:

(1) the primary particle diameter being within a range of 28 to 60 nm;

(2) the DBP oil absorption being within a range of 40 to 75 ml/100 g; and (3) the pH being within a range of 6.0 to 10.0. These property values correlate to one another from the viewpoint of the balance between image quality and safety. These property values will hereinafter be described in detail.

(1) Primary Particle Diameter

The primary particle diameter of the carbon black used in the present invention is within a range of 28 to 60 nm.

If the primary particle diameter of carbon black is smaller than the lower limit of the above range, the dispersion of the carbon black in the binder resin or polymerizable monomer becomes insufficient. Only a greatly fogged image can be provided with a developer making use of a toner comprising such carbon black. If the primary particle diameter of carbon black is too great on the other hand, the content of polycyclic aromatic hydrocarbons in the resulting toner becomes high, resulting in a failure to solve the problem of safety. From such reasons, the primary particle diameter of the carbon black used in the present invention is required to fall within the range of 28 to 60 nm that is a selected small size. The primary particle diameter is preferably within a range of 30 to 60 nm, most preferably 32 to 58 nm.

In the present invention, the primary particle diameter of carbon black means a value (average primary particle diameter) calculated out as an average value of particle diameters of 100 carbon black particles observed by an electron photomicrograph.

(2) DBP Oil Absorption

The DBP oil absorption of the carbon black used in the present invention is within a range of 40 to 75 ml/100 g.

If the DBP oil absorption of carbon black is too high even when the primary particle diameter of the carbon black falls within the above range, the carbon black tends to aggregate in the binder resin or polymerizable monomer, and the dispersion thereof becomes insufficient. Only a fogged image can be provided with a developer making use of a toner comprising such carbon black. From such a reason, the DBP oil absorption of the carbon black used in the present invention is required to fall within the range of 40 to 75 ml/100 g. From the viewpoint of more enhancing the image quality, the DBP oil absorption is preferably within a range of 40 to 69 ml/100 g, most preferably 45 to 68 ml/100 g.

The DBP oil absorption is a value measured as a DBP oil absorption per 100 g of carbon black, which is determined by means of an absorptometer at a point of time that torque reaches 70% of the maximum torque when DBP (dibutyl phthalate) is added to the carbon black.

(3) pH

The pH of the carbon black used in the present invention is within a range of 6.0 to 10.0.

If the pH of carbon black is too low even when the primary particle diameter of the carbon black falls within the above range, the dispersion of droplets of the polymerizable monomer containing the carbon black becomes unstable, resulting in a failure to provide a polymerized toner (colored polymer particles) having a narrow particle diameter distribution. No sharp image is obtained with a developer making use of such a toner. If the pH of the carbon black is too high, the dispersion of droplets of the polymerizable monomer similarly becomes unstable, resulting in a failure to provide a polymerized toner having a narrow particle diameter distribution. As a result, a problem that no sharp image is obtained arises.

The pH of the carbon black is a value obtained by measuring a pH of a mixture of the carbon black and distilled water by means of a glass electrode meter.

The pH of carbon black may also be adjusted within the desired range by a method such as immersion of the carbon black in an acid or alkali. The pH of the carbon black is preferably within a range of 6.1 to 9.8.

When the carbon black having these property values (1) to (3) is used as a colorant, a developer, which can provide images excellent in image properties and has high safety, is provided.

(4) Polycyclic Aromatic Hydrocarbons

In order to obtain a toner for development of electrostatic images having higher safety, it is desired that the total content of polycyclic aromatic hydrocarbons in the carbon black used in the present invention be preferably 15 ppm or lower, particularly preferably 10 ppm or lower.

In the present invention, the polycyclic aromatic hydrocarbons (hereinafter may be referred to as "PAH") mean the following 16 compounds which are generally contained in carbon black, and whose carcinogeneses become a problem. Namely, they are naphthalene, acenaphthylene, acenaphthene, fluorene, phenanthrene, anthracene, fluoranthene, pyrene, benzo(a)anthracene, chrysene, benzo (b)fluoranthene, benzo(k,j)fluoranthene, benzo(a)pyrene, dibenzo(a,h)anthracene, indeno(1,2,3-cd)pyrene and benzo (g,h,l)perylene.

The total content of the polycyclic aromatic hydrocarbons (PAH) in carbon black is a value obtained by precisely weighing [($W_0$) g] about 10 g of the carbon black and extracting it for 48 hours with a toluene solution in a Soxhlet extractor entirely made of glass. More specifically, an extract obtained by the extraction is concentrated and then analyzed by liquid chromatography, thereby determining the respective contents of the 16 polycyclic aromatic hydrocarbons, and the values thereof are summed up, whereby the total content of PAH can be obtained. For example, assuming that a measured value of a certain compound determined by liquid chromatography is ($W_{Ii}$) g, the content i of this compound can be calculated out in accordance with the equation:

$$(i)=(W_{Ii})/(W_0)\times 10^6 \text{(unit: ppm)}.$$

The determination is conducted as to the 16 compounds, and their values are summed, whereby the total content (ppm) of the polycyclic aromatic hydrocarbons (PAH) in the carbon black can be calculated out.

As described above, these PAH are carcinogenic. In order to avoid the risk of carcinogenesis, it is desired that the total content of PAH in carbon black to be used be preferably 15 ppm or lower, particularly preferably 10 ppm or lower.

The content of PAH in carbon black has fixed correlation with the primary particle diameter of the carbon black. When the primary particle diameter of the carbon black is small, its surface area becomes great. Therefore, PAH are easy to be volatilized by heating in the purification process of the carbon black, or the like. Further, when the primary particle diameter of the carbon black is small, the amount of PAH held within particles of the carbon black also becomes small. However, the content of PAH may be high in some cases even when the primary particle diameter of the carbon black is small. In such a case, it is preferred that the content of PAH be further reduced by, for example, removing the PAH under heating.

The carbon black is used in a proportion of generally 0.1 to 20 parts by weight, preferably 0.5 to 15 parts by weight, more preferably 1 to 10 parts by weight per 100 parts by weight of the binder resin or polymerizable monomer. In addition to the carbon black, another colorant such as a pigment or dye may be used in combination for the purpose of controlling the color tone of the resulting toner.

2. Production Process of Toner for Development of Electrostatic Images

As described above, the toner for development of electrostatic images according to the present invention may be produced either the grinding process or the polymerization process. In the case of the grinding process, it is only necessary to merely use specific carbon black having such property values as described above as a colorant.

In the case where the toner for development of electrostatic images according to the present invention is produced by the polymerization process, the use of the specific carbon black as a colorant permits marked improvement in the dispersibility of the carbon black in a polymerizable monomer composition and the dispersibility of droplets of the polymerizable monomer composition in an aqueous dispersion medium, thereby providing a polymerized toner excellent in various properties such as shelf stability, charging properties, environmental stability of image quality and durability of image quality. Therefore, the production process of the toner for development of electrostatic images according to the present invention will hereinafter be described in detail together with the individual components used laying stress on the polymerization process.

(Polymerizable Monomer)

As the polymerizable monomers useful in the practice of the present invention, monovinyl monomers may be mentioned. Specific examples thereof include styrenic monomers such as styrene, vinyltoluene and α-methyl-styrene; acrylic acid and methacrylic acid; derivatives of acrylic acid or methacrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monovinyl monomers may be used either singly or in any combination thereof. Of these monovinyl monomers, the styrenic monomers and the derivatives of acrylic acid or methacrylic acid are preferably used.

In the present invention, the combined use of a crosslinkable monomer with the above-described monovinyl monomer permits the provision of a polymerized toner improved in shelf stability and hot offset resistance. As the crosslinkable monomer, there may be used a monomer having two or more polymerizable carbon-carbon unsaturated double bonds. Specific examples thereof include aromatic divinyl compounds such as divinylbenzene, divinyl-naphthalene and derivatives thereof; di-ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups. These crosslinkable monomers may be used either singly or in any combination thereof.

When the crosslinkable monomer is used, it is used in a proportion of generally 0.01 to 5 parts by weight, preferably 0.1 to 2 parts by weight per 100 parts by weight of the monovinyl monomer.

In the present invention, the combined use of a macromonomer with the above-described monovinyl monomer permits the provision of a polymerized toner well balanced between shelf stability and low-temperature fixing ability. The macromonomer (also referred to as a macromer) is a relatively long-chain linear molecule having a polymerizable functional group (for example, a group containing an unsaturated bond such as a carbon-carbon double bond) at its molecular chain terminal. The macromonomer is preferably an oligomer or polymer having a polymerizable vinyl functional group at its molecular chain terminal and a number average molecular weight of generally 1,000 to 30,000. If a macromonomer having a too low number average molecular weight is used, the surface part of the resulting polymer particles becomes soft, and its shelf stability comes to be deteriorated. If a macromonomer having a too high number average molecular weight is used on the other hand, the melt properties of the macromonomer itself becomes poor, resulting in a polymerized toner deteriorated in fixing ability.

Examples of the polymerizable vinyl functional group that the macromonomer has at its molecular chain terminal include an acryloyl group and a methacryloyl group, with the methacryloyl group being preferred from the viewpoint of easy copolymerization.

The macromonomer preferably has a glass transition temperature (Tg) higher than that of a polymer obtained by polymerizing the monovinyl monomer. However, a difference in Tg between the polymer obtained by polymerizing the monovinyl monomer and the macromonomer may be relative. For example, when the monovinyl monomer is such that forms a polymer having a Tg of 70° C., it is only necessary for the macromonomer to have a Tg higher than 70° C. When the monovinyl monomer is such that forms a polymer having a Tg of 20° C., the macromonomer may also be that having a Tg of, for example, 60° C. Incidentally, Tg is a value measured by means of an ordinary measuring device such as a differential scanning calorimeter (DSC).

As examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991, pages 4 to 7. Of these macromonomers, hydrophilic macromonomers, in particular, polymers obtained by polymerizing methacrylic esters or acrylic esters either singly or in combination of two or more monomers thereof are preferred.

When the macromonomer is used, it is used in a proportion of generally 0.01 to 10 parts by weight, preferably 0.03 to 5 parts by weight, more preferably 0.05 to 1 part by weight per 100 parts by weight of the monovinyl monomer. If the amount of the macromonomer used is too little, the effect to improve the balance between shelf stability and fixing ability lessens. If the amount of the macromonomer used is too great, the fixing ability of the resulting polymerized toner is deteriorated.

(Charge Control Agent)

The toner for development of electrostatic images according to the present invention is preferably a non-magnetic one-component developer. In that case, a charge control agent is generally used to improve the charging properties of the resulting toner.

In the present invention, there may be used a commonly used charge control agent for positive charge or negative charge. Examples of the charge control agents include metal complexes of organic compounds having a carboxyl group or a nitrogen-containing group, metallized dyes and nigrosine. More specifically, there may be used charge control agents such as Spiron Black TRH (product of Hodogaya Chemical Co., Ltd.), T-77 (product of Hodogaya Chemical Co., Ltd.), Bontron S-34 (product of Orient Chemical Industries Ltd.), Bontron E-84 (product of Orient Chemical Industries Ltd.), Bontron N-01 (product of Orient Chemical Industries Ltd.) and Copy Blue-PR (product of Clariant.

In addition, charge control resins such as quaternary ammonium salt-containing resins and sulfonic group-containing resins may preferably be used as charge control agents. Of these, charge control resins soluble in a polymerizable monomer such as styrene are particularly preferred.

The above-described quaternary ammonium salt-containing resins can be obtained in accordance with, for example, the following processes:

(1) a process in which a vinyl aromatic hydrocarbon monomer, a (meth)acrylate monomer and an N,N-disubstituted aminoalkyl (meth)acrylate [hereinafter referred to as "amino group-containing (meth) acrylate"] are copolymerized in the presence of a polymerization initiator, and the amino groups in the resultant copolymer is then quaternized with a quaternizing agent;

(2) a process in which a vinyl aromatic hydrocarbon monomer, a (meth)acrylate monomer and a halogenated quaternary ammonium base-containing (meth) acrylate monomer obtained by converting an amino group-containing (meth)acrylate into a quaternary ammonium base with a halogenated organic compound are copolymerized in the presence of a polymerization initiator, and the formed product is then reacted with an acid to form a salt (for example, Japanese Patent Application Laid-Open No. 175456/1991);

(3) a process in which a vinyl aromatic hydrocarbon monomer, a (meth)acrylate monomer and a quaternary ammonium base-containing (meth)acrylate monomer are copolymerized in the presence of a polymerization initiator; and (4) a process in which a copolymer of a vinyl aromatic hydrocarbon monomer and a halogenated alkyl (meth) acrylate monomer, and a copolymer of a vinyl aromatic hydrocarbon monomer and an amino group-containing (meth)acrylate monomer are mixed with each other to conduct quaternization between the polymers.

Of these, a quaternary ammonium salt-containing resin obtained by copolymerizing a vinyl aromatic hydrocarbon monomer, a (meth)acrylate monomer and dimethylaminoethyl methacrylate benzyl chloride (DML) in accordance with the process (3) is preferably used. The proportion of DML to be copolymerized is generally 0.1 to 10 wt. % based on the total weight of the monomers used.

The weight average molecular weight (Mw) of the quaternary ammonium salt-containing resin is generally 2,000 to 40,000 in terms of polystyrene as measured by gel permeation chromatography (GPC) using tetrahydrofuran, and its glass transition point (Tg) is generally 30 to 100° C.

The sulfonic group-containing resins include copolymers of a vinyl monomer and a (meth)acrylamide monomer containing an $SO_2X$ group (X=H or alkali metal). Examples of the vinyl monomer include vinyl aromatic hydrocarbon monomers and (meth)acrylate monomers. The $SO_2X$ group-containing (meth)acrylamide monomer is a sulfonic group- or sulfonic base-containing (meth)acrylate monomer. Examples thereof include acids such as 2-acrylamido-2-methylpropanesulfonic acid and 2-acrylamido-2-phenylpropanesulfonic acid, and metal salts thereof, such as sodium and potassium salts. These respective monomers may be used either singly or in any combination thereof.

The proportion of the $SO_2X$ group-containing (meth) acrylamide monomer to be copolymerized is generally 0.1 to 10 wt. % based on the total weight of the monomers used. Examples of a polymerization process include solution polymerization, bulk polymerization and suspension polymerization. The weight average molecular weight (Mw) of the sulfonic group-containing resin is generally 2,000 to 25,000 in terms of polystyrene as measured by GPC using tetrahydrofuran.

The charge control agent is used in a proportion of generally 0.01 to 10 parts by weight, preferably 0.03 to 5 parts by weight per 100 parts by weight of the polymerizable monomer.

(Dispersion Stabilizer)

The suspension polymerization is generally conducted in an aqueous dispersion medium containing a dispersion stabilizer. As the dispersion stabilizer, there may be used any of various kinds of dispersion stabilizers heretofore used. Among these stabilizers, inorganic dispersing agents are preferred from the viewpoint of the properties of the resulting polymerized toner. The inorganic dispersing agents are preferably hardly water-soluble inorganic dispersing agents, with colloids of hardly water-soluble metallic compounds being particularly preferred. Among the colloids of hardly water-soluble metallic compounds, colloids of hardly water-soluble metal hydroxides are preferred because the particle diameter distribution of the resulting polymerized toner can be narrowed, and the brightness or sharpness of an image formed from such a polymerized toner is enhanced. As examples of the hardly water-soluble metallic compounds, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide.

Of these, metal hydroxides such as aluminum hydroxide, magnesium hydroxide and ferric hydroxide are cationic dispersing agents and preferred because they are hard to be adsorbed on the surface of the resulting polymerized toner, so that the particle form of the toner is adjusted to provide images excellent in image quality and durability of image quality. Colloids of the hardly water-soluble metallic compounds are particularly preferably used as the dispersion stabilizer in that the particle diameter distribution of the resulting polymerized toner can be narrowed. The colloids of the hardly water-soluble metal hydroxides are not limited by the production process thereof. However, it is preferred to use colloid of a water-soluble polyvalent metallic compound, in particular, colloid of a hardly water-soluble metal hydroxide formed by reacting a water-soluble polyvalent metallic compound with an alkali metal hydroxide in an aqueous phase.

The colloid of the hardly water-soluble metallic compound used in the present invention preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m. If the particle diameter of the colloid is too great, the stability of the polymerization reaction system is broken, and the shelf stability of the resulting toner is deteriorated.

The dispersion stabilizer (particularly, inorganic dispersing agent) is used in a proportion of generally 0.01 to 20 parts by weight, preferably 0.1 to 10 parts by weight per 100 parts by weight of the polymerizable monomer. If the proportion of the dispersion stabilizer used is too low, it is difficult to achieve sufficient polymerization stability, so that polymer aggregates are liable to form. If the proportion of the dispersion stabilizer used is too high on the other hand, the viscosity of the aqueous dispersion medium becomes too high, and the particle diameter distribution of the resulting polymerized toner becomes wide. It is hence not preferred to use the dispersion stabilizer in such a too low or high proportion.

(Additives)

In the present invention, various kinds of additives, such as secondary materials for polymerization such as polymerization initiators for polymerizing the polymerizable monomer and molecular weight modifiers, parting agents, lubricants, and dispersion aids may also be used. These additive components are generally incorporated into the polymerizable monomer composition before use. However, they may be added to the aqueous dispersion medium according to circumstances. For example, when the polymerization initiator is incorporated into the polymerizable monomer composition from the first, premature polymerization tends to occur. When the polymerization initiator is added into the aqueous dispersion medium in the course of the formation of droplets of the polymerizable monomer composition, however, it migrates into the droplets, and so a toner having uniform properties is easy to produce.

<Polymerization Initiator>

As examples of the polymerization initiator, may be mentioned persulfates such as potassium persulfate and ammonium persulfate; azo compounds such as 4,4-azobis-(4-cyanovaleric acid), 2,2-azobis(2-amidinopropane) bihydrochloride, 2,2-azobis-2-methyl-N-1,1-bis-(hydroxymethyl)-2-hydroxyethylpropionamide, 2,2'-azobis-(2,4-dimethylvaleronitrile), 2,2'-azobisisobutyronitrile and 1,1'-azobis(1-cyclohexanecarbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate. Redox initiators composed of combinations of these polymerization initiators with a reducing agent may also be mentioned.

Of these polymerization initiators, oil-soluble radical initiators are preferred, with oil-soluble radical initiators selected from among organic peroxides whose ten-hour half-life temperatures are 60 to 80° C., preferably 65 to 80° C. and whose molecular weights are 250 or lower being particularly preferred. Of the oil-soluble radical initiators, t-butyl peroxy-2-ethylhexanoate is particularly preferred because the resulting polymerized toner scarcely gives odor upon printing and barely causes environmental destruction by volatile components such as odor.

The amount of the polymerization initiator used is generally 0.001 to 3 wt. % based on the aqueous dispersion medium. If the amount of the polymerization initiator used is too little, the rate of polymerization becomes slow. Any too great amount results in a polymerized toner having a low molecular weight and is not economical. It is hence not preferred to use the polymerization initiator in such a too little or great amount.

<Molecular Weight Modifier>

In the present invention, a molecular weight modifier may be used. Examples of the molecular weight modifier include mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is used in a proportion of generally 0.01 to 10 parts by weight, preferably 0.1 to 5 parts by weight per 100 parts by weight of the polymerizable monomer.

<Parting Agent>

In the present invention, a parting agent may be contained in the toner. As examples of the parting agent, may be mentioned polyfunctional ester compounds such as pentaerythritol tetrastearate; low molecular weight polyolefins such as low molecular weight polyethylene, low molecular weight polypropylene and low molecular weight polybutylene; and paraffin waxes. Of these, the polyfunctional ester compounds, particularly, ester compounds composed of pentaerythritol and a carboxylic acids having 10 to 30 carbon atoms, specifically, pentaerythritol tetrastearate and pentaerythritol tetramyristate are preferred. The parting agent is used in a proportion of generally 0.1 to 40 parts by weight, preferably 1 to 20 parts by weight per 100 parts by weight of the polymerizable monomer. If the proportion of the parting agent used is too low, the effect to improve the low-temperature fixing ability becomes little. If the proportion is too high, the blocking resistance (shelf stability) of the resulting polymerized toner is deteriorated.

<Lubricant and Dispersion Aid>

In the present invention, any of various kinds of lubricants such as oleic acid, stearic acid, various waxes, and olefinic lubricants such as polyethylene and polypropylene; a dispersion aid such as a silane or titanium coupling agent; and/or the like may also be used with a view toward uniformly dispersing the carbon black. Such a lubricant or dispersion aid is generally used in a proportion of about 1/1,000 to 1/1 based on the weight of the colorant (carbon black).

<Suspension Polymerization>

In the production process of a toner according to the present invention, a polymerizable monomer and carbon black, and optionally, a charge control agent, a crosslinkable monomer, a molecular weight modifier and other additives are mixed to uniformly disperse them by means of a ball mill or the like, thereby preparing a polymerizable monomer composition (liquid mixture). This liquid mixture is poured into an aqueous medium containing a dispersion stabilizer to suspend it in the aqueous medium. The resultant suspension is stirred to form droplets of the polymerizable monomer composition.

When a polymerization initiator is not contained in the polymerizable monomer composition in advance, the polymerization initiator is added into the aqueous medium after the formation of primary droplets of the polymerizable monomer composition, and the primary droplets are finely dispersed in the aqueous dispersion medium by means of a mixer having high shearing force until secondary droplets of the toner size are formed, and at the same time the polymerization initiator is caused to migrate into the droplets. No particular limitation is imposed on the mixer having high shearing force. However, examples thereof may include mixers of the system that a liquid is passed through between a rotor which rotates on its axis at high speed, and a stator surrounding it and having small openings or comb-like teeth.

The dispersed state of the polymerizable monomer composition (liquid mixture) in the aqueous dispersion medium is a state that the volume average droplet diameter of droplets (secondary droplets) of the polymerizable monomer composition amounts to generally 0.1 to 20 $\mu$m, preferably 0.5 to 10 $\mu$m. If the droplets are too great, toner particles formed become too great, so that the resolution of an image formed with such a toner is deteriorated.

A ratio of volume average droplet diameter/number average droplet diameter of said droplets is generally 1 to 3, preferably 1 to 2. If the droplet diameter distribution of the droplets is too wide, the fixing temperature of the resulting toner varies, so that inconveniences such as fogging and filming tend to occur. The droplets desirably have a droplet diameter distribution that at least 50 vol. %, preferably, at least 60 vol. % of the droplets are present within a range of (the volume average droplet diameter ±1 $\mu$m).

In the present invention, it is preferred that a dispersion of the polymerizable monomer composition be prepared and then charged into a polymerization reactor to conduct polymerization. More specifically, the polymerizable monomer composition is added to the aqueous dispersion medium in a vessel for preparation of a dispersion to prepare a dispersion of the polymerizable monomer composition. The dispersion is preferably transferred to another vessel (vessel for polymerization reaction) to conduct polymerization there. According to a process comprising preparing a dispersion in a polymerization reactor and conducting a polymerization reaction as it is like the conventional suspension polymerization process, scale occurs in the reactor, and coarse particles of a toner tend to form in plenty.

After fine droplets of the polymerizable monomer composition are formed in the aqueous dispersion medium containing the dispersion stabilizer, they are heated to a temperature of generally 30 to 200° C., preferably 35 to 120° C. to conduct suspension polymerization. The polymerization reaction is continued until the conversion of the monomer into the polymer reaches generally at least 80%, preferably at least 85%, more preferably at least 90%. If the conversion into the polymer is too low, the polymerizable monomer remains unreacted, so that the remaining monomer volatilizes when the resulting toner is heated and fixed, thereby worsening working environment.

The toner according to the present invention can be provided as a toner in which the individual components are uniformly dispersed in the binder resin (polymer). However, a core-shell structure may be imparted thereto if desired. In order to form a core-shell structure when a polymerized toner is produced, it is preferable to adopt, for example, a process comprising polymerizing droplets of a polymerizable monomer composition containing a polymerizable monomer and a colorant (carbon black) in an aqueous dispersion medium, and then adding another polymerizable monomer, which is capable of forming a polymer having a Tg higher than that of a polymer formed from the first-mentioned polymerizable monomer, to continue the polymerization, thereby forming a shell layer. The toner of the core-shell structure formed by this process is excellent in balance between blocking resistance (shelf stability) and low-temperature fixing ability.

According to the production process of the present invention, there are provided colored polymer particles (polymerized toner) having a volume average particle diameter of generally 0.5 to 20 μm, preferably 1 to 10 μm. The ratio of the volume average particle diameter (dv) to the number average particle diameter (dp) of this polymerized toner is generally at most 1.7, preferably at most 1.5, more preferably at most 1.4.

3. Developer

The toner for development of electrostatic images according to the present invention may be used as a non-magnetic one-component developer as it is. However, it is generally combined with external additives such as a flowability-imparting agent and an abrasive to provide a developer. Such external additives attach to the surface of the toner and bear an action that the flowability of the toner is enhanced, or that the formation of a toner film on a photosensitive member or the like is prevented by their abrading action. The toner according to the present invention may be combined with a carrier and used as a two-component developer.

(External Additives)

External additives used in the production of the developer according to the present invention include inorganic particles and organic resin particles. Examples of the inorganic particles include particles of silicon dioxide, aluminum oxide, titanium oxide, zinc oxide, tin oxide, barium titanate, strontium titanate, etc. Examples of the organic resin particles include particles of methacrylic ester polymers, acrylic ester polymers, styrene-methacrylic ester copolymers and styrene-acrylic ester copolymers, and core-shell type particles in which the core is composed of a methacrylic ester polymer, and the shell is composed of a styrene polymer.

Of these, the particles of the inorganic oxides are preferred, with the silicon dioxide particles being particularly preferred. The surfaces of these particles may be subjected to a hydrophobicity-imparting treatment. Silicon dioxide particles subjected to the hydrophobicity-imparting treatment are particularly preferred. No particular limitation is imposed of the amount of the external additives added. However, it is generally 0.1 to 6 parts by weight per 100 parts by weight of the toner.

Two or more of the external additives may be used in combination. When the external additives are used in combination, it is preferable to use two or more kinds of inorganic oxide particles or organic resin particles different in average particle diameter from each other in combination. More preferably, it is preferable to use particles (preferably inorganic oxide particles) having an average particle diameter of 5 to 20 nm, preferably 7 to 18 nm and particles (preferably inorganic oxide particles) having an average particle diameter of greater than 20 nm, but not greater than 2 μm, preferably 30 nm to 1 μm in combination to attach them to the toner. The average particle diameter of the external additive particles means an average value of particle diameters of 100 particles selected and measured at random from among particles observed through a transmission electron microscope.

The amounts of the above two kinds of external additive particles are generally 0.1 to 3 parts by weight, preferably 0.2 to 2 parts by weight per 100 parts by weight of the toner for the particles having an average particle diameter of 5 to 20 nm and generally 0.1 to 3 parts by weight, preferably 0.2 to 2 parts by weight for the particles having an average particle diameter of greater than 20 nm, but not greater than 2 μm. A weight ratio of the particles having an average particle diameter of 5 to 20 nm to the particles having an average particle diameter of greater than 20 nm, but not greater than 2 μm is within a range of generally 1:5 to 5:1, preferably 10:3 to 3:10.

In order to attach the external additives to the toner, in general, the external additives and the toner are charged into a mixer such as a Henschel mixer to mix them under stirring.

4. Image Forming Apparatus

An image forming apparatus, to which the toner according to the present invention is applied, is generally an image forming apparatus such as an electrophotographic copying machine or printer of the non-magnetic one-component development system.

Such an image forming apparatus generally comprises a photosensitive member (photosensitive drum), a means for charging the surface of the photosensitive member, a means for forming an electrostatic latent image on the surface of the photosensitive member, a means for receiving a developer, a means for supplying the developer to develop the electrostatic latent image on the surface of the photosensitive member, thereby forming a developer image, a means for transferring the developer image from the surface of the photosensitive member to a transfer medium, and a fixing means. As needed, the apparatus is also equipped with a cleaning device for cleaning off the toner remaining on the photosensitive member, and the like.

EXAMPLES

The present invention will hereinafter be described more specifically by the following Examples and Comparative Examples. However, the present invention is not limited to these examples only. Incidentally, all designations of "part" or "parts" and "%" as will be used in the following examples mean part or parts by weight and wt. % unless expressly noted.

Various properties in the following Examples and Comparative Examples were evaluated in accordance with the following respective methods.

(Properties of Carbon Black)

(1) Primary Particle Diameter (nm)

It is a value calculated out as an average value of particle diameters of 100 carbon black particles observed by an electron photomicrograph.

(2) DBP Oil Absorption (ml/100 g)

It is a value measured as a DBP oil absorption per 100 g of carbon black, which is determined by means of an absorptometer at a point of time that torque reaches 70% of the maximum torque when DBP is added to the carbon black.

(3) pH

It is a value obtained by measuring a pH of a mixture of carbon black and distilled water by means of a glass electrode meter.

(4) PAH Content (ppm)

About 10 g of the carbon black was precisely weighed [($W_0$) g] and extracted for 48 hours with a toluene solution in a Soxhlet extractor entirely made of glass. An extract obtained by the extraction was concentrated and then analyzed by liquid chromatography. The PAH content is a value calculated out by using a measured value ($W_{li}$) g of an i-th PAH compound in accordance with the following two equations:

$$(i)=(W_{li})/(W_0)\times 10^6 \text{ (unit: ppm)},$$

$$\text{PAH content}=\Sigma(i)\ (i=1 \text{ to } 16).$$

Analytical Conditions

Column: Vydac ODS,

Fluid phase: Water/acetonitrile; concentration gradient of acetonitrile=20 minutes at $60+(t/5.85)^3$ (in which t=0 to 20), and then 2 minutes at 100% of acetonitrile, Liquid temperature: 35° C., Flow rate: 2 ml/min, and Detector: Ultraviolet/fluorescence detector.

(Flowability)

Three kinds of sieves (sieve openings: 150, 75 and 45 μm, respectively) are laid on top of another in that order from above, and a developer (4 g) to be measured was precisely weighed and put on the uppermost sieve. The three kinds of sieves are vibrated for 15 seconds by means of a powder measuring device (manufactured by Hosokawa Micron Corporation) under conditions of vibration intensity of 4. Thereafter, the weight of the developer which remained on each sieve was measured and substituted into its corresponding equation shown below, thereby calculating out the respective numeric values of a, b and c. The numeric values were used to calculate out the flowability (%) in accordance with the following equation. The measurement was conducted 3 times on one sample to use the average value thereof as an index to the flowability.

Equations for Calculating $a$=[(weight (g) of the developer remaining on the sieve of 150 μm)/4 g]×100;

$b$=[(weight (g) of the developer remaining on the sieve of 75 μm)/4 g]×100×0.6;

$c$=[(weight (g) of the developer remaining on the sieve of 45 μm)/4 g]×100×0.2;

and

Flowability (%)=100−($a$+$b$+$c$).

(Shelf Stability)

Each developer sample was placed in a closed container to seal it, and the container was sunk into a constant-temperature water bath controlled to 55° C. The developer was quietly taken out of the container after a predetermined period of time went on, and transferred to a 42-mesh sieve so as not to destroy the structure thereof as much as possible. The sieve was vibrated for 30 seconds by means of a powder measuring device (manufactured by Hosokawa Micron Corporation) under conditions of vibration intensity of 4.5. The weight of the developer remaining on the sieve was measured to regard it as the weight of the developer aggregated. A proportion (wt. %) by weight of the aggregated developer to the whole developer was calculated out. The measurement was conducted 3 times on one sample to use the average value thereof as an index to the shelf stability.

(Electrical Resistance)

The electrical resistance of each developer sample was measured by means of a dielectric meter ("TRS-10 Model", trade name; manufactured by Ando Electric Co., Ltd.) under conditions of a temperature of 30° C. and a frequency of 1 kHz.

(Dependence of Image Quality on Environment)

Each developer sample was charged into a printer (4 papers per minute printer) of a non-magnetic one-component development system, and printing was continuously conducted from the beginning under (H/H) environment of 30° C. in temperature and 80% in relative humidity (RH) and (L/L) environment of 10° C. in temperature and 20% in RH to count the number of printed sheets that continuously retained an image density of 1.3 or higher as measured by a reflection densitometer (manufactured by Macbeth Co.) and at an unprinted area, fog of 10% or lower as measured by a whiteness meter (manufactured by Nippon Denshoku K. K.), thereby evaluating the developer sample as to the environmental stability of image quality in accordance with the following standard:

○: the number of the printed sheets that continuously retained the above-described image quality was 1,000 or more;

Δ: the number of the printed sheets that continuously retained the above-described image quality was not less than 500, but less than 1,000; and X: the number of the printed sheets that continuously retained the above-described image quality was less than 500.

(Durability of Image Quality)

Each developer sample was charged into the above-described printer, and printing was continuously conducted from the beginning under room-temperature environment of 23° C. and 50% RH to count the number of printed sheets that continuously retained an image density of 1.3 or higher as measured by a reflection densitometer (manufactured by Macbeth Co.) and at an unprinted area, fog of 10% or lower as measured by a whiteness meter (manufactured by Nippon Denshoku K. K.), thereby evaluating the developer sample as to the durability of image quality in accordance with the following standard:

○the number of the printed sheets that continuously retained the above-described image quality was 10,000 or more;

Δ: the number of the printed sheets that continuously retained the above-described image quality was not less than 5,000, but less than 10,000; and X: the number of the printed sheets that continuously retained the above-described image quality was less than 5,000.

Example 1

(1) Preparation of Styrene.parting Agent Dispersion

Styrene (90 parts) and a parting agent ("FT-100", trade name; product of Shell MDS Co.; 10 parts) were charged into a media type wet grinding machine to conduct wet grinding, thereby preparing a styrene.parting agent dispersion, in which the parting agent had been uniformly dispersed in styrene. The volume average particle diameter of the parting agent in this dispersion was 3.2 μm in terms of $D_{50}$ and 7.2 μm in terms of $D_{90}$. The solids content in this dispersion was 10.1%. The volume average particle diameter was measured by means of an SALD-2000J (manufactured by Shimadzu Corporation) by adding the sample to styrene, subjecting the mixture to an ultrasonic treatment to prepare a dispersion, and then adding the dispersion dropwise to a measuring cell.

(2) Preparation of Polymerizable Monomer Composition (Liquid Mixture)

The styrene.parting agent dispersion (20 parts) obtained in the step (1), styrene (65 parts), n-butyl acrylate (17 parts), carbon black (Carbon Black A shown in Table 1; 7 parts), a charge control agent (Spiron Black TRH; product of Hodogaya Chemical Co., Ltd.; 1.0 part) and divinylbenzene (0.3 parts) were stirred and mixed by an ordinary stirring apparatus and then uniformly dispersed by a media type dispersing machine, thereby obtaining a polymerizable monomer composition (liquid mixture).

(3) Preparation of Colloid Solution of Hardly Water-soluble Metal Hydroxide

An aqueous solution with sodium hydroxide (alkali metal hydroxide; 6.2 parts) dissolved in ion-exchanged water (50 parts) was gradually added to an aqueous solution with magnesium chloride (water-soluble polyvalent metallic salt; 10.2 parts) dissolved in ion-exchanged water (250 parts) under stirring to prepare a dispersion of magnesium hydroxide colloid (colloid of hardly water-soluble metal hydroxide).

The particle diameter distribution of the colloid formed was measured by means of a microtrack particle diameter distribution measuring device (manufactured by Nikkiso Co., Ltd.) and found to be 0.37 μm in terms of $D_{50}$ (50% cumulative value of number particle diameter distribution) and 0.81 μm in terms of $D_{90}$ (90% cumulative value of number particle diameter distribution). The measurement by means of the microtrack particle diameter distribution measuring device was performed under the following conditions:

measuring range: 0.12 to 704 μm;

measuring time: 30 seconds; and medium: ion-exchanged water.

(4) Suspension Polymerization

The polymerizable monomer composition obtained in the step (2) was poured into the colloidal dispersion of magnesium hydroxide obtained in the step (3), the mixture was stirred until droplets (primary droplets) became stable, and t-butyl peroxy-2-ethylhexanoate (7 parts) was then added as a polymerization initiator. Thereafter, the resultant dispersion was stirred at 12,000 rpm under high shearing force by means of a TK type homomixer to form fine droplets (secondary droplets) of the polymerizable monomer composition. The thus-prepared aqueous dispersion containing droplets of the polymerizable monomer composition was charged into a reactor equipped with an agitating blade to initiate a polymerization reaction at 90° C. After the reaction was continuously conducted for 8 hours, the reaction was stopped to obtain an aqueous dispersion of colored polymer particles having a pH of 9.5.

While stirring the above-obtained aqueous dispersion of the colored polymer particles, the pH of the system was adjusted to about 5.5 with sulfuric acid to conduct acid washing (25° C., 10 minutes). Filtration and hydration were then conducted, and washing water was sprayed on the residue after the dehydration to conduct water washing. Thereafter, the thus-treated residue was dried for 2 days by a dryer (at 45° C.) to obtain dry colored polymer particles (polymerized toner).

(5) Preparation of Developer

Silica ("R-202", trade name; product of Degussa AG; 0.8 parts) subjected to a hydrophobicity-imparting treatment and having an average particle diameter of 14 nm was added to the colored polymer particles (100 parts) obtained above, and they were mixed by means of a Henschel mixer to prepare a non-magnetic one-component developer. The volume average particle diameter of the developer thus obtained was 7.1 μm.

The evaluation of image revealed that at both high temperature and high humidity (H/H), and low temperature and low humidity (L/L), extremely good images good in color tone, high in image density and free of fog were obtained. The results are shown in Table 1.

Example 2

An experiment was performed in the same manner as in Example 1 except that Carbon Black A used in Example 1 was changed to Carbon Black B shown in Table 1. The results are shown in Table 1.

Comparative Example 1

An experiment was performed in the same manner as in Example 1 except that Carbon Black A used in Example 1 was changed to Carbon Black 1 shown in Table 1. The results are shown in Table 1.

Comparative Example 2

An experiment was performed in the same manner as in Example 1 except that Carbon Black A used in Example 1 was changed to Carbon Black 2 shown in Table 1. The results are shown in Table 1.

TABLE 1

| | Example | | Comp. Example | |
|---|---|---|---|---|
| | 1 | 2 | 1 | 2 |
| Carbon Black | A | B | 1 | 2 |
| Primary particle diameter (nm) | 34 | 56 | 25 | 75 |
| DBP oil absorption (ml/100 g) | 48 | 46 | 71 | 71 |
| pH | 8.5 | 9.5 | 9.0 | 8.0 |
| PAH (ppm) | ≦10 | ≦10 | ≦10 | 120 |
| Particle diameter of toner (μm) | 7.1 | 7.0 | 7.2 | 7.1 |
| Fixing temperature (° C.) | 140 | 150 | 140 | 150 |
| Flowability (%) | 85 | 88 | 86 | 82 |
| Shelf stability | 0.6 | 0.4 | 0.4 | 0.4 |
| Electrical resistance (logΩ/cm) | 11.1 | 11.2 | 10.3 | 11.6 |
| Image quality: | | | | |
| Environmental stability | | | | |
| (H/H) | ○ | ○ | Δ | ○ |
| (L/L) | ○ | ○ | Δ | ○ |
| Durability | ○ | ○ | x | ○ |

Example 3

An experiment was performed in the same manner as in Example 1 except that Carbon Black A used in Example 1 was changed to Carbon Black C shown in Table 2. The results are shown in Table 2.

Example 4

An experiment was performed in the same manner as in Example 1 except that Carbon Black A used in Example 1 was changed to Carbon Black D shown in Table 2. The results are shown in Table 2.

Comparative Example 3

An experiment was performed in the same manner as in Example 1 except that Carbon Black A used in Example 1 was changed to Carbon Black 3 shown in Table 2. The results are shown in Table 2.

TABLE 2

| | Example | | Comp. Example |
|---|---|---|---|
| | 3 | 4 | 3 |
| Carbon Black | C | D | 3 |
| Primary particle diameter (nm) | 34 | 38 | 28 |
| DBP oil absorption (ml/100 g) | 48 | 66 | 100 |
| pH | 8.5 | 9.0 | 9.5 |
| PAH (ppm) | ≦10 | ≦10 | ≦10 |
| Particle diameter of toner (μm) | 7.1 | 7.0 | 6.8 |

TABLE 2-continued

| | Example | | Comp. Example |
|---|---|---|---|
| | 3 | 4 | 3 |
| Fixing temperature (° C.) | 140 | 140 | 140 |
| Flowability (%) | 85 | 89 | 75 |
| Shelf stability | 0.6 | 0.8 | 0.6 |
| Electrical resistance (logΩ/cm) | 11.1 | 11.3 | 10.5 |
| Image quality: | | | |
| Environmental stability | | | |
| (H/H) | ○ | ○ | x |
| (L/L) | ○ | ○ | Δ |
| Durability | ○ | ○ | Δ |

Example 5

An experiment was performed in the same manner as in Example 1 except that Carbon Black A used in Example 1 was changed to Carbon Black E shown in Table 3. The results are shown in Table 3.

Comparative Example 4

An experiment was performed in the same manner as in Example 1 except that Carbon Black A used in Example 1 was changed to Carbon Black 4 shown in Table 3. The results are shown in Table 3.

TABLE 3

| | Example 5 | Comp. Ex. 4 |
|---|---|---|
| Carbon Black | E | 4 |
| Primary particle diameter (nm) | 40 | 31 |
| DBP oil absorption (ml/100 g) | 63 | 45 |
| pH | 6.3 | 3.5 |
| PAH (ppm) | ≦10 | ≦10 |
| Particle diameter of toner (μm) | 7.1 | 7.0 |
| Fixing temperature (° C.) | 140 | 140 |
| Flowability (%) | 85 | 72 |
| Shelf stability | 0.4 | 0.4 |
| Electrical resistance (logΩ/cm) | 11.4 | 11.1 |
| Image quality: | | |
| Environmental stability | | |
| (H/H) | ○ | x |
| (L/L) | ○ | Δ |
| Durability | ○ | x |

It is understood from the results shown in Tables 1 to 3 that when carbon black whose primary particle diameter, DBP oil absorption and pH have been selected along the lines of the present invention is used, toners excellent in printing properties and safety can be provided.

Industrial Applicability

According to the present invention, there are provided toners for development of electrostatic images, which are low in the content of polycyclic aromatic hydrocarbons contained in carbon black, far excellent in safety and excellent in printing properties. The toners for development of electrostatic images according to the present invention can be suitably used in printers and copying machines of a non-magnetic one-component development system.

What is claimed is:

1. A toner for development of electrostatic images, which is obtained by subjecting a polymerizable monomer composition containing at least a polymerizable monomer and carbon black to suspension polymerization and is suitable for use in a non-magnetic one-component development system, wherein the carbon black has the following features:

(1) the primary particle diameter being within a range of 38 to 60 nm;

(2) the DBP oil absorption being within a range of 40 to 69 ml 100 g;

(3) the pH being within a range of 6.0 to 10.0; and (4) the total content of polycyclic aromatic hydrocarbons being 10 ppm or lower.

2. The toner for development of electrostatic images according to claim 1, wherein the DBP oil absorption of the carbon black is within a range of 45 to 68 ml/100 g.

3. A non-magnetic one-component developer comprising a toner for development of electrostatic images according to claim 2 and external additives.

4. The toner for development of electrostatic images according to claim 1, wherein the pH of the carbon black is within a range of 6.1 to 9.8.

5. A non-magnetic one-component developer comprising a toner for development of electrostatic images according to claim 4 and external additives.

6. The toner for development of electrostatic images according to claim 1, wherein the suspension polymerization is performed in an aqueous dispersion medium containing a dispersion stabilizer.

7. The toner for development of electrostatic images according to claim 6, wherein the dispersion stabilizer is a hardly water-soluble inorganic dispersing agent.

8. A non-magnetic one-component developer comprising a toner for development of electrostatic images according to claim 7 and external additives.

9. A non-magnetic one-component developer comprising a toner for development of electrostatic images according to claim 6 and external additives.

10. A non-magnetic one-component developer comprising the toner for development of electrostatic images according to claim 1 and external additives.

11. The toner for development of electrostatic images according to claim 1, wherein the primary particle size of the carbon black is within a range of 38 to 58 nm.

12. The toner for development of electrostatic images according to claim 11, wherein the DBP oil absorption of the carbon black is within a range of 45–68 ml/100 g.

13. A process for producing a toner for development of electrostatic images, which is suitable for use in a non-magnetic one-component development system, by subjecting a polymerizable monomer composition containing at least a polymerizable monomer and carbon black to suspension polymerization, the process comprising using, as the carbon black, that having the following features:

(1) the primary particle diameter being within a range of 38 to 60 nm;

(2) the DBP oil absorption being within a range of 40 to 69 ml/100 g;

(3) the pH being within a range of 6.0 to 10.0; and (4) the total content of polycyclic aromatic hydrocarbons being 10 ppm or lower.

14. The production process according to claim 13, wherein the DBP oil absorption of the carbon black is within a range of 45 to 68 ml/100 g.

15. The production process according to claim 13, wherein the pH of the carbon black is within a range of 6.1 to 9.8.

16. The production process according to claim 13, wherein the suspension polymerization is performed in an aqueous dispersion medium containing a dispersion stabilizer.

17. The production process according to claim 16, wherein the dispersion stabilizer is a hardly water-soluble inorganic dispersing agent.

18. The production process according to claim 17, wherein the hardly water-soluble inorganic dispersing agent is colloid of a hardly water-soluble metallic compound.

19. The production process according to claim 18, wherein the colloid of the hardly water-soluble metallic compound is colloid of a hardly water-soluble metal hydroxide.

* * * * *

UNITED STATES PATENT AND TRADEMARK OFFICE

CERTIFICATE OF CORRECTION

PATENT NO. : 6,440,628 B1
DATED : August 27, 2002
INVENTOR(S) : Makoto Watanabe et al.

It is certified that error appears in the above-identified patent and that said Letters Patent is hereby corrected as shown below:

Title page, item [54] and Column 1, line 1,
In the title change "TONES" to -- TONER --;

Signed and Sealed this

Seventeenth Day of December, 2002

JAMES E. ROGAN
*Director of the United States Patent and Trademark Office*